US011036171B2

(12) United States Patent
Kunihisa et al.

(10) Patent No.: US 11,036,171 B2
(45) Date of Patent: Jun. 15, 2021

(54) IMAGE FORMING DEVICE, DEVELOPER STIRRING METHOD AND NON-TRANSITORY RECORDING MEDIUM

(71) Applicant: Konica Minolta, Inc., Tokyo (JP)

(72) Inventors: Teppei Kunihisa, Toyohashi (JP); Soh Hirota, Toyokawa (JP); Shigeki Naiki, Toyokawa (JP); Hironori Akashi, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/999,556

(22) Filed: Aug. 21, 2020

(65) Prior Publication Data

US 2021/0055680 A1 Feb. 25, 2021

(30) Foreign Application Priority Data

Aug. 22, 2019 (JP) ..... JP2019-152012

(51) Int. Cl.
*G03G 15/00* (2006.01)
*G03G 15/08* (2006.01)

(52) U.S. Cl.
CPC ..... *G03G 15/5041* (2013.01); *G03G 15/0887* (2013.01); *G03G 15/0889* (2013.01)

(58) Field of Classification Search
CPC ..... G03G 15/0855; G03G 15/0887; G03G 15/0889; G03G 15/5041
See application file for complete search history.

(56) References Cited

U.S. PATENT DOCUMENTS 4,801,980 A * 1/1989 Arai ..... G03G 15/0855 118/689
2019/0056681 A1* 2/2019 Sakai ..... G03G 15/0889

FOREIGN PATENT DOCUMENTS

JP 2014106344 A 6/2014

* cited by examiner

*Primary Examiner* — Hoang X Ngo
(74) *Attorney, Agent, or Firm* — Cantor Colburn LLP

(57) ABSTRACT

An image forming device to and from which a developing unit in which a developer containing toner is filled is detachable and removable, comprises a hardware processor that: enables the developing unit to perform a stir operation of the developer filled in the developing unit as an initial operation of the developing unit; obtains a reference value of a toner density set in advance in time of a factory shipment of the developing unit at time the stir operation is performed; and compares a toner density received from the developing unit during the stir operation with the reference value to determine a stir condition of the developer.

27 Claims, 10 Drawing Sheets

FIG. 6

| STIR OPERATION | STIR SCREW | | VIBRATION MEMBER |
|---|---|---|---|
| | ROTATION DIRECTION | ROTATION SPEED | |
| FIRST OPERATION | FORWARD DIRECTION | LOW SPEED | ON |
| SECOND OPERATION | REVERSE DIRECTION | LOW SPEED | ON |
| THIRD OPERATION | FORWARD DIRECTION | HIGH SPEED | ON |
| FORTH OPERATION | REVERSE DIRECTION | HIGH SPEED | ON |

IMAGE FORMING DEVICE, DEVELOPER STIRRING METHOD AND NON-TRANSITORY RECORDING MEDIUM

The present invention claims priority under 35 U.S.C. § 119 to Japanese Application No. 2019-152012 filed on Aug. 22, 2019, the entire content of which is incorporated herein by reference.

BACKGROUND

Technological Field

The present invention relates to an image forming device, a developer stirring method and a non-transitory recording medium. One or more embodiments of the present invention more specifically relate to a technique for stirring developer filled in a developing unit attached to the image forming device.

Description of the Related Art

Developer containing toner and carrier is filled in a developing unit attached to an image forming device. The developer in the developing unit has a change of a bulk density influenced by a transit environment or a storage environment after factory shipment. To be more specific, an influence by surrounding environment of the developer in transit and/or in being stored may cause an aggregation of the toner so that the bulk density changes. The developer may have the bulk density changed compared to the bulk density in time of the factory shipment. When an image is formed using the developer that has the changed bulk density, a smoke may be caused and inside the device may get dirty, resulting in an occurrence of an image density defect.

As one of ways to solve this problem, an initial stirring operation is performed when a new developing unit is attached to the image forming device, for example. This known technique is introduced for example in Japanese Patent Application Laid-Open No. JP 2014-106344 A. According to the known technique, a screw in the developing unit is driven for a certain period of time set in advance at a setup at a customer site to stir the developer.

According to the known technique, however, the period of time to perform the initial stirring operation is fixed to the period of time set in advance. When the bulk density change is large, the stirring time is not sufficient. Even after the initial stirring operation, the developer may not be loosened sufficiently. In this case, when the image is formed after the initial stirring operation, it may still cause smoke and/or the image density defect.

In order to surely resolve the problem of smoke or the image density defect, it is required to set in advance a long initial stirring operation time. The longer initial stirring operation time, the longer setup time at the customer site. Thus, it will take the longer setup time to make the image forming device usable state. When the bulk density change is small, the developer is loosened sufficiently at a relatively early timing after start of the initial stirring operation. Even so, the initial stirring operation continues for a long time. The image forming device cannot be used for a long time.

SUMMARY

One or more embodiments provide an image forming device, a developer stirring method and a non-transitory recording medium that are enabled to determine if a developer is loosened to a condition almost equivalent to a condition in time of a factory shipment.

In one aspect, the present invention is directed to an image forming device to and from which a developing unit in which a developer containing toner is filled is detachable and removable.

According to an aspect of the present invention, the image forming device comprises a hardware processor that: enables the developing unit to perform a stir operation of the developer filled in the developing unit as an initial operation of the developing unit; obtains a reference value of a toner density set in advance in time of a factory shipment of the developing unit at time the stir operation is performed; and compares a toner density received from the developing unit during the stir operation with the reference value to determine a stir condition of the developer.

In another aspect, the present invention is directed to a developer stirring method.

According to an aspect of the present invention, the developer stirring method comprises: setting in advance a reference value of a toner density in time of a factory shipment of a developing unit in which a developer containing toner is filled; enabling the developing unit to perform a stir operation of the developer filled in the developing unit as an initial operation of the developing unit when the developing unit is attached to an image forming device and the developing unit becomes operative for the first time in the image forming device; obtaining the reference value at time the stir operation is performed; and comparing a toner density received from the developing unit during the stir operation with the reference value to determine a stir condition of the developer.

In another aspect, the present invention is directed to a non-transitory recording medium storing a computer readable program to be executed by a hardware processor in an image forming device to and from which a developing unit in which a developer containing toner is filled is detachable and removable.

According to an aspect of the present invention, the non-transitory recording medium storing a computer readable program to be executed by the hardware processor in the image forming device causing the hardware processor to perform: enable the developing unit to perform a stir operation of the developer filled in the developing unit as an initial operation of the developing unit; obtain a reference value of a toner density set in advance in time of a factory shipment of the developing unit at time the stir operation is performed; and compare a toner density received from the developing unit during the stir operation with the reference value to determine a stir condition of the developer.

BRIEF DESCRIPTION OF THE DRAWING

The advantages and features provided by one or more embodiments of the invention will become more fully understood from the detailed description given herein below and the appended drawings which are given by way of illustration only, and thus are not intended as a definition of the limits of the present invention.

FIG. 6 illustrates an example of types of a stir operation by a stir controller;

DETAILED DESCRIPTION OF EMBODIMENTS

Hereinafter, embodiments of the present invention will be described with reference to the drawings. However, the scope of the invention is not limited to the disclosed embodiments.

First Embodiment

Figure 1:
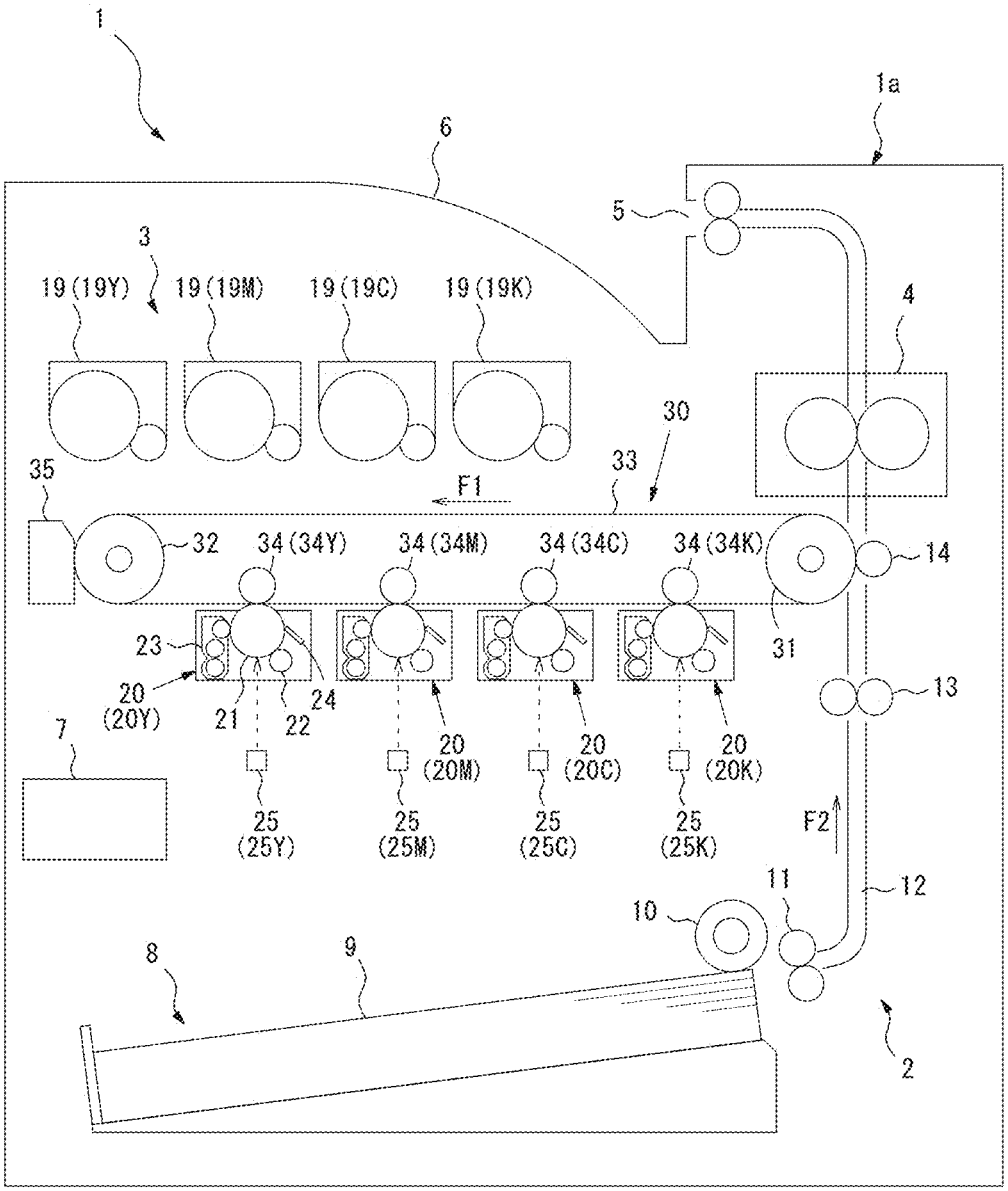
FIG. 1 illustrates an exemplary structure of an image forming device.

FIG. 1 illustrates an exemplary structure of an image forming device 1 in which the first embodiment of the present invention may be practiced. The image forming device 1 is a printer that forms an image on a sheet material 9 such as a printing sheet and outputs in electrophotography. The image forming device 1 is capable of forming a color image in tandem system. The image forming device 1 includes a feeding unit 2, an image forming unit 3 and a fixing unit 4 inside a device body 1*a*. The image forming device 1 delivers the sheet material 9 stored in a sheet feeding cassette 8 one by one. The sheet feeding cassette 8 is provided in a lower part of the device body 1*a*. The image forming device 1 forms a color image or a black and white image on the sheet material 9, and delivers the sheet material 9 on a sheet delivery tray 6 through a sheet delivery port 5 provided in an upper part of the device body 1*a*. The image forming device 1 includes a controller 7 inside the device body 1*a*. The controller 7 controls operations of each part such as the feeding unit 2, the image forming unit 3 and the fixing unit 4. The controller 7 controls a stiffing operation of a developer filled in a developing unit in advance as described later.

The feeding unit 2 includes the sheet feeding cassette 8, a pick-up roller 10, a sheet feeding unit 11, a carrying path 12, a resisting unit 13 and a secondary transfer roller 14. The sheet feeding cassette 8 is a container in which a bundle of the sheet materials 9 are stored. The pick-up roller 10 takes the sheet material 9 from a top of the bundle of the sheet materials 9 stored in the sheet feeding cassette 8, and feeds out toward the sheet feeding unit 11. The pick-up roller 10 may feed the multiple sheet materials 9 toward the downstream side of the sheet feeding cassette 8. The sheet feeding unit 11 picks up the single sheet material 9 on the top of one or more than one sheet material 9 fed by the pick-up roller 10.

The carrying path 12 is a path to carry the sheet material 9 toward an arrow F2 direction. The resisting unit 13 corrects the skew of the sheet material 9 carried along the carrying path 12. The resisting unit 13 includes a pair of rollers. The resisting unit 13 drives the pair of rollers in accordance with a timing a toner image formed by the image forming unit 3 moves to a position of the secondary transfer roller 14 to carry the sheet material 9, the skew of which is corrected, to a position of the secondary transfer roller 14. The toner image formed by the image forming unit 3 is transferred to the sheet material 9 when the sheet material 9 passes through the secondary transfer roller 14. The toner image transferred to a surface of the sheet is then fixed when the sheet material 9 passes through the fixing unit 4. The fixing unit 4 conducts a heating process and a pressing process on the carried sheet material 9 to fix the toner image to the sheet material 9. The sheet 9 is then delivered on the paper delivery tray 6 through the delivery port 5.

The image forming unit 3 forms toner images of four colors, Y (yellow), M (magenta), C (cyan) and K (black), and transfers the toner images of the four colors at the same time to the sheet material 9 passing through the position of the secondary transfer roller 14. The image forming unit 3 includes multiple toner bottles 19 (19Y, 19M, 19C and 19K) of the respective colors, multiple image forming units 20 (20Y, 20M, 20C and 20K) of the respective colors, multiple exposure units 25 (25Y, 25M, 25C and 25K) of the respective colors and a transfer unit 30.

The transfer unit 30 is formed from a pair of rollers 31 and 32 and an endless belt. The pair of rollers 31 and 32 are arranged with a predetermined interval in between. The transfer unit 30 includes an intermediate transfer belt 33, multiple primary transfer rollers 34 (34Y, 34M, 34C and 34K) and a cleaner 35, and they are integrally assembled. The intermediate transfer belt 33 is crossed between the pair of rollers 31 and 32. The multiple primary transfer rollers 34 are arranged at positions facing the respective image forming units 20 inner side of the intermediate transfer belt 33. The cleaner 35 is to remove a toner remaining on a surface of the intermediate transfer belt 33.

The roller 31 which is one of the pair of rollers 31 and 32 is a driving roller which is attached to a driving shaft arranged inner side of the device body 1*a* and rotates. The rotation of the driving shaft enables a circulating movement of the intermediate transfer belt 33 in an arrow F1 direction. Another roller 32 is attached to a driven shaft arranged inside the device body 1*a*. Another roller 32 rotates by the circulating movement of the intermediate transfer belt 33. The pair of rollers 31 and 32 apply certain tension to the intermediate transfer belt 33 and they are arranged at positions separated from each other of a predetermined interval inside the device body 1*a*. The roller 31 is attached to the driving shaft so that it is arranged at a position facing the secondary transfer roller 14. The roller 31 sandwiches the intermediate transfer belt 33 between itself and the secondary transfer roller 14, and applies a pressing force to the intermediate transfer belt 33. The roller 31 sandwiches and presses the sheet material 9 fed from the resisting unit 13 between the intermediate transfer belt 33 and the secondary transfer roller 14 so that the toner image formed on the surface of the intermediate transfer belt 33 is secondarily transferred to the sheet material 9.

The cleaner 35 is kept in a state that is in contact with the surface of the intermediate transfer belt 33 at a position that faces the roller 32. The cleaner 35 removes a toner remaining on the surface of the intermediate transfer belt 33 that circularly moves in the arrow F1 direction.

The image forming units 20Y, 20M, 20C and 20K corresponding to the respective colors are provided in a lower position of the transfer unit 30. The exposure units 25Y, 25M, 25C and 25K corresponding to the respective colors are arranged in a further lower position of each of the image forming units 20Y, 20M, 20C and 20K. The toner bottles 19Y, 19M, 19C and 19K are provided in an upper position of the transfer unit 30 to supply a developer containing a toner of each color to the respective image forming units 20Y, 20M, 20C and 20K.

Each image forming unit 20Y, 20M, 20C and 20K has the similar structure but uses the different color of toner. To be more specific, each image forming unit 20Y, 20M, 20C and 20K includes an image carrier 21 formed as a photoreceptor drum, an electrifying unit 22 arranged around the image carrier 21, a developing unit 23 and a cleaning blade 24. If differentiation between each image forming unit 20Y, 20M, 20C and 20K is not necessary, the image units 20Y, 20M, 20C and 20K may be called as the image forming unit 20.

The image carrier 21 has a photosensitive layer on a drum surface. The image carrier 21, for instance, is in contact with the intermediate transfer belt 33 to which a transferring force by the primary transfer roller 34 of the transfer unit 30 is applied, and rotates in a clockwise direction. Along the rotation direction, the cleaning blade 24, the electrifying unit 22 and the developing unit 23 are arranged around the image carrier 21. The electrifying unit 22 includes an electrifying roller that is in contact with the surface of the image carrier 21, and charges the surface of the image carrier 21 at a predetermined charge amount. The exposure unit 25 exposures the photosensitive layer charged by the electrifying unit 22 based on the image data to form a latent image on the surface of the image carrier 21. The developing unit 23 is filled with a developer containing the toner and a carrier. The developer is supplied to the surface of the image carrier 21 and the latent image is enabled to be visible with the toner. The toner image is then formed on the surface of the image carrier 21. The toner image formed on the image carrier 21 is primarily transferred to the intermediate transfer belt 33 at a position at which the toner image gets in contact with the intermediate transfer belt 33. A bias voltage which is a reverse polarity from the charged toner image formed on the surface of the image carrier 21 is applied to the primary transfer roller 34. The primary transfer roller 34 is enabled to primarily transfer the toner image formed on the surface of the image carrier 21 to the intermediate transfer belt 33 by an electrostatic power.

Each image forming unit 20Y, 20M, 20C and 20K works together with the corresponding primary transfer roller 34Y, 34M, 34C and 34K to superpose the toner image of each color one after another on the intermediate transfer belt 33 which is circulated and moved in the arrow direction F1 and enable primary transfer. When the intermediate transfer belt 33 passes through the position of the image forming unit 20K which is at downstream end, a color image which is superposing the toner images of four colors is formed on the surface of the intermediate transfer belt 33. In order to form a black and white image on the sheet material 9, the image forming units 20Y, 20M and 20C are not brought into operation. Only the image forming unit 20K corresponding to K (black) becomes operative to form the black and white image on the intermediate transfer belt 33 with the toner of K.

The toner image formed on the intermediate transfer belt 33 gets in contact with the sheet material 9 carried by the feeding unit 2 and secondarily transferred on the surface of the sheet material 9 when passing through a position facing the secondary transfer roller 14. To be more specific, the secondary transfer roller 14 is arranged at a position facing the roller 31 across the intermediate transfer belt 33. The secondary transfer roller 14 applies the bias voltage which is a reverse polarity from the charged toner when the toner image primarily transferred to the intermediate transfer belt 33 is in contact with the sheet material 9 so that the toner image is secondarily transferred to the sheet material 9.

Even after the secondary transfer of the toner image to the sheet material 9 at the secondary transfer roller 14, some of the toner may remain on the surface of the intermediate transfer belt 33. The remaining toner is attached to the surface of the intermediate transfer belt 33 and is circularly moved together with the intermediate transfer belt 33. When the intermediate transfer belt 33 passes through the cleaner 35, the remaining toner is removed from the surface of the intermediate transfer belt 33 by a cleaning blade or a cleaning brush provided with the cleaner 35.

Even after the toner image formed on the image carrier 21 is primarily transferred to the intermediate transfer belt 33 in each image forming unit 20Y, 20M, 20C and 20K, some toner may remain on the surface of the image carrier 21. The remaining toner proceeds toward the cleaning blade 24 in accordance with the rotation of the image carrier 21, and removed from the surface of the image carrier 21 by the cleaning blade 24.

Figure 2:
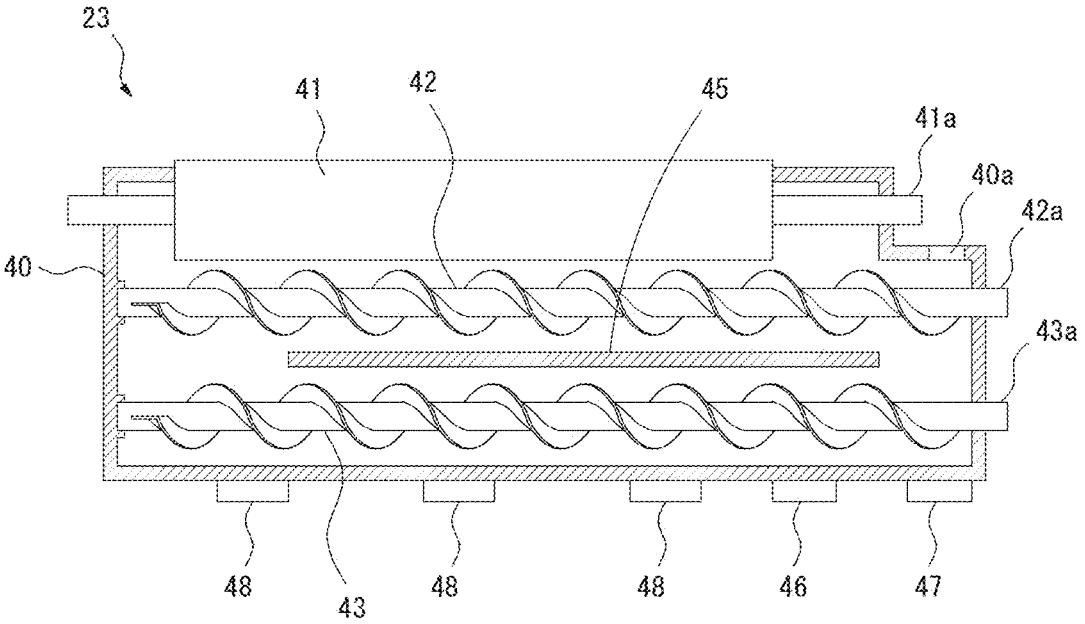
FIG. 2 illustrates an example of a cross section of a developing unit.

The developing unit 23 is explained next. FIG. 2 illustrates an example of a cross section of the developing unit 23. The developer containing the toner and the carrier is filled inside a body 40 of the developing unit 23. The developing unit 23 is detachable and removable to and from the image forming unit 20. In other words, the developing unit 23 is detachable and removable to and from the device body 1*a* of the image forming device 1. The body 40 of the developing unit 23 is provided with a toner supply port 40*a* at a predetermined position. The developer supplied from the toner bottle 19 is supplied inside through the toner supply port 40*a*. Once the developing unit 23 is attached to the device body 1*a*, the developing unit 23 can be refilled with the developer supplied from the toner bottle 19 through the toner supply port 40*a*. For the new developing unit 23, the developer is filled in advance in a filling space of the body 40 at the factory shipment.

As illustrated in FIG. 2, the developing unit 23 is provided with a developing sleeve 41, a supply screw 42 and a stir screw 43 inside the body 40. In addition, a partition 45 is arranged inside the body 40 of the developing unit 23. The partition 45 separates an upper space and a lower space. In the upper space, the developing sleeve 41 and the supply screw 42 are arranged, and in the lower space, the stir screw 43 is arranged. The upper space and the lower space separated by the partition 45 communicate with each other through both ends of the supply screw 42 and the stir screw 43, realizing transfer of the developer.

The developing sleeve 41 is arranged in the upper space separated by the partition 45. A part of the developing sleeve 41 is exposed to outside from the body 40. The exposed part of the developing sleeve 41 is arranged at a predetermined interval from the surface of the image carrier 21. Once the developing unit 23 is attached to the device body 1*a*, a rotation shaft 41*a* connects to a motor provided with the device body 1*a* so that the developing sleeve 41 rotates and is driven in a predetermined direction. The developing sleeve 41 rotates in the predetermined direction to supply the developer supplied from the supply screw 42 to the surface of the image carrier 21.

The supply screw 42 is one of stir parts that have a function to stir the developer. The supply screw 42 is arranged in parallel with the developing sleeve 41. The supply screw 42 includes a rotation shaft 42*a* that rotates and is driven by a motor of the device body 1*a*. The rotation shaft 42*a* is driven to rotate in a predetermined direction so that the supply screw 42 transfers the developer supplied from the lower space along a longitudinal direction of the developing sleeve 41 and supplies the developer to the developing sleeve 41.

The stir screw 43 is another part of stir parts to stir the developer. The stir screw 43 is arranged in parallel with the supply screw 42. The stir screw 43 includes a rotation shaft 43*a* that rotates and is driven by a motor of the device body 1*a*. The stir screw 43 may be driven by the same motor as that used for the supply screw 42. In view of circulation of the developer inside the body 40, the stir screw 43 and the supply screw 42 preferably rotate and are driven in the counter direction.

The stir screw 43 rotates in a predetermined direction to stir the developer and transfer the developer along a longitudinal direction of the screw. As a result, the toner contained in the developer can be friction charged. After stirring the developer in the lower space (stirring space) of the developing unit 23, the stir screw 43 draws the developer to the upper space through the part communicated with the upper space in one end of the partition 45.

The developing sleeve 41 includes a magnet member inside its inner periphery. The magnet member catches the charged toner on the surface of the sleeve. The developing sleeve 41 rotates, and supplies the toner caught on the surface of the sleeve to the surface of the image carrier 21. A ratio of the toner and the carrier in the body 40 decreases, the less developer is caught on the surface of the sleeve, resulting in the density defect. In order to keep the ratio of the toner and the carrier at a certain value, the stir operation is performed by the supply screw 42 and the stir screw 43 in the developing unit 23.

The developing unit 23 includes a toner density sensor 46, a storage 47 and multiple vibration members 48 attached to an exterior-wall of the body 40.

The toner density sensor 46 is arranged on the exterior-wall of the body 40 around the stir screw 43, for example. The toner density sensor 46 detects toner density (ratio of the toner and the carrier) of the developer filled in the body 40. The toner density sensor 46 is constructed by a Colpitts oscillator circuit, for instance. The Colpitts oscillator circuit is a LC tuning oscillator circuit formed from a coil and two capacitors. An oscillation frequency is determined based on a capacitance of the two capacitors and an inductance of the coil. Hence, the toner density sensor 46 constructed by the Colpitts oscillator circuit outputs a variation of the inductance of the coil due to a variation of the ratio of the toner and the carrier in the body 40 as a variation of the oscillation frequency.

Figure 3:
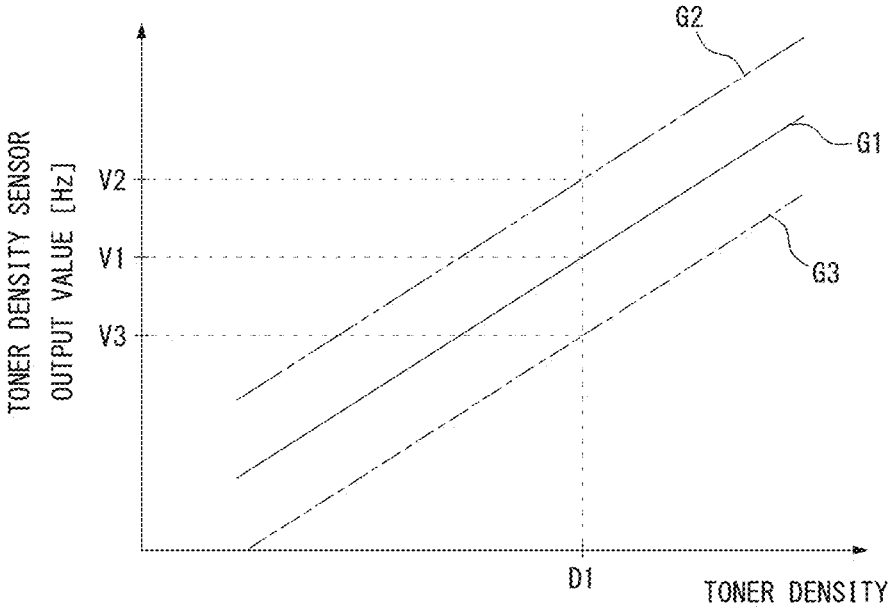
FIG. 3 illustrates exemplary output characteristics of a toner density sensor.

FIG. 3 illustrates exemplary output characteristics of the toner density sensor 46. As shown by an output characteristic G1 of FIG. 3, the toner density sensor 46 outputs a frequency relative to the toner density in the developing unit 23. The developer with a certain toner density D1 (8%, for instance) is filled in the body 40 of the new developing unit 23, for example. It is assumed, for example, the developer in the body 40 is sufficiently stirred at time of the factory shipment. In this case, a value output by the toner density sensor 46 is the frequency (output value) corresponding to the certain toner density D1. The toner density sensor 46 having the output characteristic G1 of FIG. 3, for example, outputs an output value V1 corresponding to the certain toner density D1 when the developer in the body 40 is sufficiently stirred at time of the factory shipment.

There are individual variations in the toner density sensors 46. The individual variations cause variations in the output characteristics. It is assumed, for example, the output characteristic of the toner density sensor 46 installed on the developing unit 23 is the output characteristic G1 of FIG. 3. Even in this case, the output characteristic of the toner density sensor 46 installed on another developing unit 23 may be an output characteristic G2 of FIG. 3, or an output characteristic G3. To be more specific, even when the certain toner density D1 of the developer is filled in the body 40, an output value output by the toner density sensor 46 may vary if the developing unit 23 is different.

In the first embodiment, when the developer in the body 40 is sufficiently stirred at time of the factory shipment, the toner density is measured by the toner density sensor 46 and the output value of the frequency output by the toner density sensor 46 is stored in the storage 47. The stored output value is set in advance as a reference value of the toner density. The toner density of the developer in the body 40 which is sufficiently stirred does not always have to be actually measured by the toner density sensor 46 for setting the reference value of the toner density in time of the factory shipment. The output characteristic of the toner density sensor 46, for instance, may be measured and the output value in a case where the developer with the certain toner density D1 is measured may be calculated by an operation based on the output characteristic. The output value calculated by the operation may be set as the reference value of the toner density.

The storage 47 is a nonvolatile storage constructed by a semiconductor memory, for instance. The reference value of the toner density set in advance at the factory shipment of the developing unit 23 as described above is stored in the storage 47.

Each of the multiple vibration members 48 is one of stirring parts that stir the developer. The multiple vibration members 48 are arranged on the exterior-wall around the stir screw 43 at predetermined intervals along a longitudinal direction of the stir screw 43. Each vibration member 48 is constructed by a vibration motor, for instance. The vibration motor rotates an output shaft to which a vibrator is attached to generate vibration. The multiple vibration members 48 vibrate the exterior-wall to vibrate the developer in the body 40. The developer is thus stirred. Hence, the developer is not only stirred by the supply screw 42 and the stir screw 43 but also vibrated by the vibration member 48 so that the developer is easily loosened.

Figure 4:
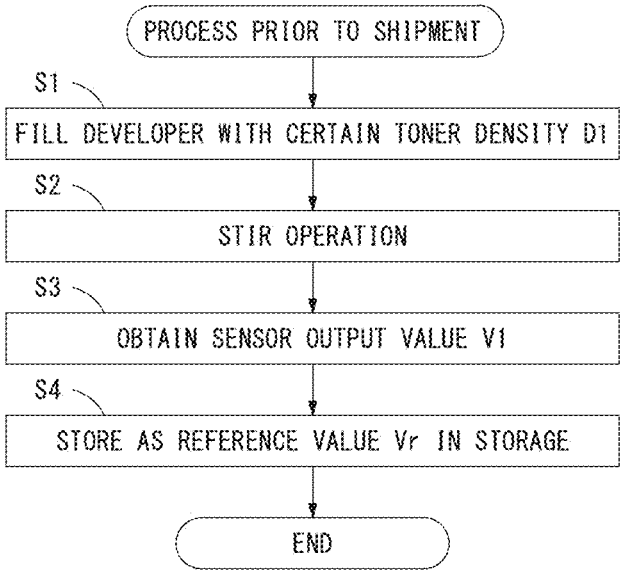
FIG. 4 illustrates a flow diagram explaining an exemplary procedure of the process to set a reference value of a toner density performed prior to a factory shipment of the developing unit.

FIG. 4 illustrates a flow diagram explaining an exemplary procedure of the process to set the reference value of the toner density performed prior to the factory shipment of the developing unit 23. The process of FIG. 4 should be performed prior to the shipment of the developing unit 23 and it may be performed during the manufacture. As illustrated in FIG. 4, the developer with the certain toner density D1 is filled in the body 40 of the developing unit 23 (step S1). After the developer is filled in the body 40, the supply screw 42, the stir screw 43 and the vibration members 48 are driven and the filled developer is stirred in the developing unit 23 (step S2). Due to this stirring operation, the developer in the body 40 is sufficiently stirred. The developing unit 23 then obtains the output value received from the toner density sensor 46 while the developer has been sufficiently stirred as a reference value Vr of the toner density. The developing unit 23 stores the reference value Vr in the storage 47. The above-described process is performed so that the reference value Vr obtained at time of the measurement of the certain toner density D1 by the toner density sensor 46 installed on the developing unit 23 is set with the developing unit 23 shipped from the factory.

The developing unit 23 shipped from the factory is influenced by the surrounding environment in transit and/or in being stored. The influence may cause an aggregation of the toner so that the bulk density changes. To be more specific, the aggregation of the toner causes the higher bulk density of the developer in the body 40. Higher bulk density of the developer, lower toner density measured by the toner density sensor 46. More specifically, even when the developer with the certain toner density is filled in the body 40 of the developing unit 23, the higher bulk density causes lower output value received from the toner density sensor 46.

The controller 7 of the image forming device 1 stirs the developer filled in the body 40 of the developing unit 23 as an initial operation when putting the developing unit 23 attached to the device body 1*a* into operation for the first time. Due to the stir operation, the developer filled in the body 40 of the developing unit 23 is enabled to put the aggregation of the toner back to the condition (the developer is sufficiently loosened) equivalent to the condition in time of the factory shipment. The controller 7 determines the stirring condition of the developer filled in the body 40 based on the toner density (frequency) received from the toner density sensor 46 and the reference value Vr of the toner density set in advance at the factory shipment. The controller 7 is described in detail below.

Figure 5:
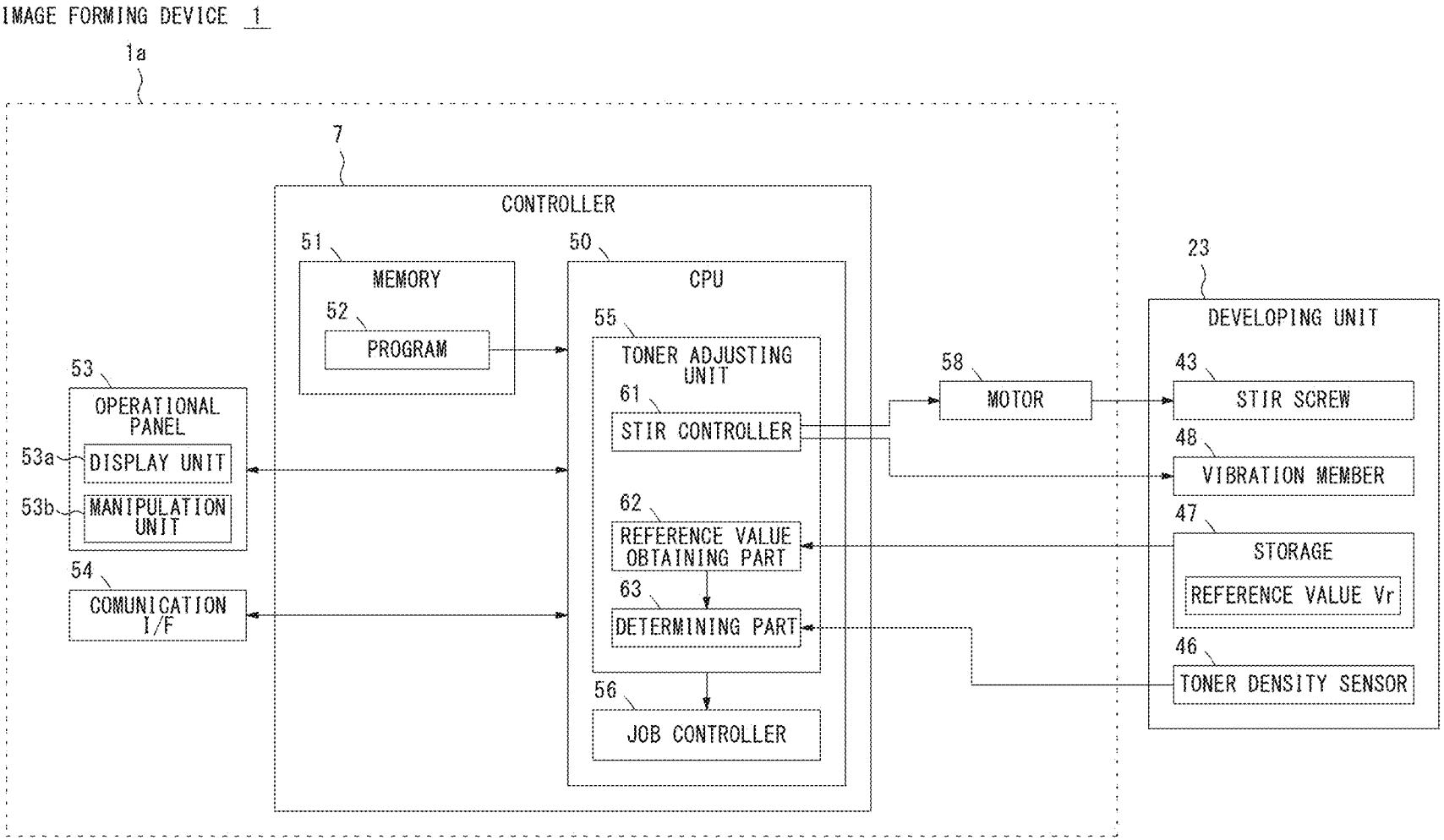
FIG. 5 illustrates a block diagram showing an example of a control mechanism of a controller of the image forming device.

FIG. 5 illustrates a block diagram showing an example of a control mechanism of the controller 7 of the image forming device 1. The device body 1*a* of the image forming device 1 is provided with the controller 7, an operational panel 53, a communication interface 54 and a motor 58. The controller 7 includes a CPU 50 and a memory 51. The CPU 50 is a hardware processor that reads and executes a program 52 stored in the memory 51. The memory 51 is a nonvolatile storage formed from a hard disk drive (HDD) or a solid-state drive (SSD), for example. The program 52 stored in the memory 51 is a developer stirring program.

The operational panel 53 is a user interface for a user to use the image forming device 1. The operational panel 53 includes a display unit 53*a* and a manipulation unit 53*b*. The display unit 53*a* is constructed by a device such as a liquid crystal display, for instance. A variety of information is displayed on the display unit 53*a*. The manipulation unit 53*b* is constructed by a part such as a touch panel key and/or a push-button key. The manipulation unit 53*b* receives an input by the user. The communication interface 54 connects the image forming device 1 to a network such as LAN (Local Area Network) to enable communications with external devices. The image forming device 1, for example, is enabled to receive a print job via the communication interface 54. When the developing unit 23 is attached to the device body 1*a*, the motor 58 is a driving resource that connects to at least the rotation shaft 43*a* of the stir screw 43 and rotates the stir screw 43. The motor 58 may be connected to the rotation shaft 42*a* of the supply screw 42 via a link mechanism and rotate the supply screw 42 and the stir screw 43 at the same time.

The CPU 50 of the controller 7 reads and executes the program 52 in the memory 51 to serve as a toner adjusting unit 55 and a job controller 56. The toner adjusting unit 55 becomes operative when the developing unit 23 attached to the device body 1*a* is brought into operation for the first time. The toner adjusting unit 55 controls an operation to stir the developer filled in the body 40 as an initial operation of the developing unit 23. The job controller 56 becomes operative after the initial operation of the developing unit 23 by the toner adjusting unit 55 is successfully completed. The job controller 56 controls a processing of a print job specified by the user. Upon receiving the print job via the communication interface 54, for example, the job controller 56 drives each of the feeding unit 2, the image forming unit 3 and the fixing unit 4 in a synchronized manner based on the print job. The job controller 56 controls to enable an image to print included in the print job to be formed correctly on the sheet material 9.

The toner adjusting unit 55 includes a stir controller 61, a reference value obtaining part 62 and a determining part 63. The toner adjusting unit 55 brings each part into operation to enable the developing unit 23 to perform a stir operation as the initial operation.

The stir controller 61 enables the developing unit 23 to perform the stir operation of the developer filled in the body 40 of the developing unit 23 to be performed as the initial operation of the developing unit 23. To be more specific, the stir controller 61 drives the motor 58 and rotates the stir screw 43 to stir the developer in the body 40. The stir controller 61 also drives the vibration members 48 attached to the exterior-wall of the body 40 to cause the developer in the body 40 to vibrate and stir.

The stir controller 61 enables the developing unit 23 to perform the stir operation of the developer until a stir period set in advance elapses. The stir controller 61 switches the stir operation by each stir part such as the stir screw 43 or the vibration members 48 during the stir period. In the stir period, the stir operation is switched so that the developer is easily loosened. It is assumed, for example, the stir screw 43 rotates in one direction to stir the developer and that does not enable the developer to be loosened. Even in such a case, if the stir screw 43 rotates in an opposite direction, the developer may be loosened. It is assumed, for example, the stir screw 43 rotates at a predetermined speed doesn't enable the developer to be loosened. Even in such a case, the speed of the rotation of the stir screw 43 may be changed and the developer may be loosened. The stir controller 61 switches the manner of the stir operation by the stir part such as the stir screw 43 or the vibration members 48 in the stir period in order to loosen the developer sufficiently within the stir period.

FIG. 6 illustrates an example of types of the stir operation by the stir controller 61. The stir controller 61, for example, controls four types of stir operations, a first operation, a second operation, a third operation and a fourth operation, to be performed in the stir period. As the first operation, the stir controller 61 enables the stir screw 43 to rotate in the forward direction set in advance and the rotation speed is set at low speed. As the second pertain, the stir controller 61 enables the stir screw 43 to rotate in the reverse direction which is opposite from the forward direction and the rotation speed of the stir screw 43 is set at low speed. As the third operation, the stir controller 61 enables the stir screw 43 to rotate in the forward direction and the rotation speed of the stir screw 43 is set at high speed. As the fourth operation, the stir controller 61 enables the stir screw 43 to rotate in the reverse direction and the rotation speed of the stir screw 43 is set at high speed. In the example of FIG. 6, the vibration members 48 activate in every operation through the first to the fourth operations. However, this is given not for limitation. The activation of the vibration members 48 can be switched for each operation.

The stir controller 61 divides the stir period to enable the developing unit 23 to perform the stir operation, for example, into to four periods, a first period, a second period, a third period and a fourth period. The stir controller 61 allocates each of the four periods to the above-described four types of the stir operations, respectively. Every time the period elapses, the stir controller 61 switches the stir operation. As a result, the multiple types of stir operations are performed for the developer filled in the developing unit 23 in the stir period. The condition of the developer that has an aggregation of the toner and causing the higher bulk density can be back to the condition equivalent to the condition in time of the factory shipment.

The reference value obtaining part 62 obtains the reference value Vr of the toner density set in advance at the factory shipment of the developing unit 23 when the stir operation is performed by stir controller 61. The developing unit 23 is attached to the device body 1*a* so that the developing unit 23 is electrically connected to the controller 7. The reference value obtaining part 62 reads the reference value Vr set in advance at the factory shipment stored in the storage 47 provided with the developing unit 23 attached to the device body 1*a* to obtain the reference value Vr of the toner density. The reference value obtaining part 62 outputs the reference value Vr read from the storage 47 to the determining part 63.

The determining part 63 compares the toner density received from the toner density sensor 46 of the developing unit 23 with the reference value Vr during the stir operation performed by the stir controller 61. It is assumed that the toner density received from the toner density sensor 46 of the developing unit 23 reaches a value near the reference value Vr during the stir operation performed by the stir controller 61. In this case, the developer in the body 40 of the developing unit 23 is loosened to the condition almost equivalent to the condition in time of factory shipment, and the determining part 63 determines the developer is sufficiently stirred. To be more specific, before the new developing unit 23 is being in use, the developer with the certain toner density D1 is filled in the body 40 of the developer 23. If the developer is sufficiently stirred at the initial operation of the developing unit 23, the bulk density of the developer recovers to the condition equivalent to the condition in time of the factory shipment. The toner density detected by the toner density sensor 46 shows almost the same value as the reference value Vr set in advance at the factory shipment. Hence, when the toner density received from the toner density sensor 46 of the developing unit 23 shows the value near the reference value Vr, the determining part 63 determines that the developer is sufficiently stirred.

The determining part 63 determines that the value is near the reference value Vr when the toner density detected by the toner density sensor 46 is within a predetermined range of the reference value Vr. When the toner density detected by the toner density sensor 46 is within a range from about few percentages to below 20 percentages less or greater than the reference value Vr, the determining part 63, for example, determines the toner density is the value near the reference value Vr.

The determining part 63 monitors the toner density received from the toner density sensor 46 constantly or every predetermined period of time during the stir period in which the stir operation is performed by the stir controller 61. After detecting that the toner density reaches the value within the predetermined range of the reference value Vr during the stir period, the determining part 63 completes the stir operation by the stir controller 61. Even when the stir period has not elapsed, the stir operation can be completed at earlier stage at the time of recovery if the developer filled in the developing unit 23 is recovered to the condition equivalent to the condition in time of factory shipment. Thus, the print job using the developing unit 23 can be started in the image forming device 1 earlier.

The toner density received from the toner density sensor 46 may not reach the value within the predetermined range of the reference value Vr at time of elapse of the stir period. In this case, the determining part 63 notifies an abnormality. The determining part 63, for example, displays a notification on the display unit 53*a* of the operational panel 53. The screen shows that the toner density is an abnormal value. By looking at the screen, the user or the maintenance operator is notified the abnormality. The notification of the abnormality does not have to be carried out through the screen displayed on the display unit 53*a*. The abnormality may be notified by a warning sound output from a speaker which is not illustrated in figures.

It is assumed that the toner density received from the toner density sensor 46 does not reach the value within the predetermined range of the reference value Vr during the stir period. In such a case, the determining part 63 restricts the job controller 56 to process the print job. As a result, problems like generation of smoke and/or the density defect can be avoided.

Figure 7:
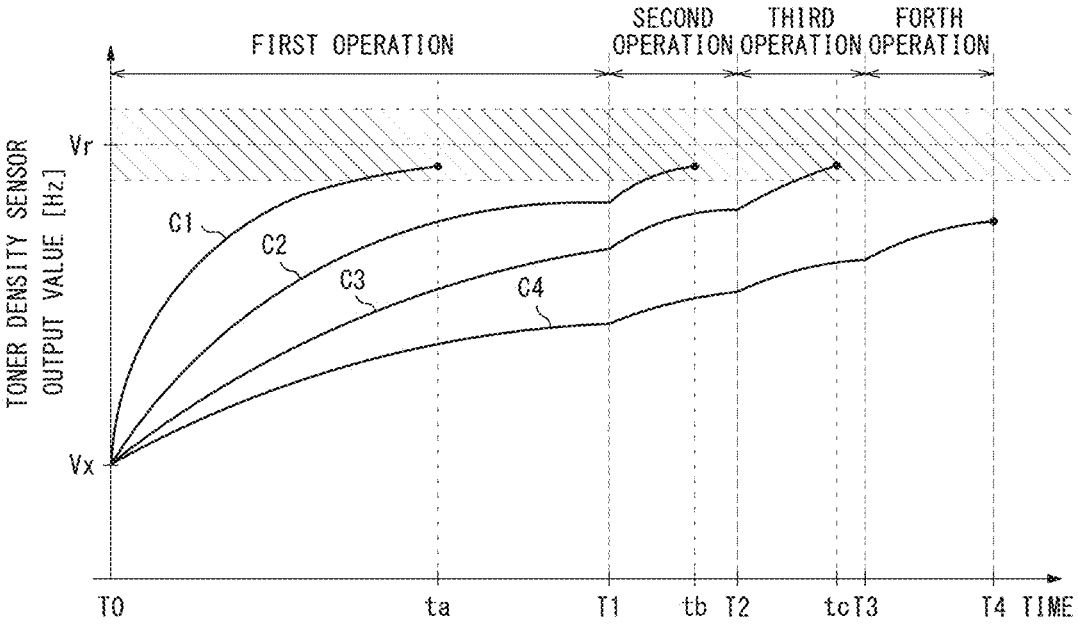
FIG. 7 illustrates an exemplary relation between an elapsed time of the stir operation performed as an initial operation of the developing unit and a value output by the toner density sensor.

FIG. 7 illustrates an exemplary relation between the elapsed time of the stir operation performed as the initial operation of the developing unit 23 and the value output by the toner density sensor 46. An area within the predetermined range of the reference value Vr is illustrated as a slanted line area in FIG. 7. The bulk density of the developer filled in the developing unit 23 may be higher than the value in time of the factory shipment. In this case, the value output by the toner density sensor 46 shows a value lower than the reference value Vr. The value is not in the predetermined range of the reference value Vr. The toner density sensor 46, for example, outputs a value Vx.

The stir controller 61 enables the developing unit 23 to perform the stir operation during the stir period from a timing T0 to a timing T4, for instance. The stir controller 61 enables the developing unit 23 to perform the first stir operation during the first period from the timing T0 to the timing T1. The degree of change of the bulk density of the developer filled in the developing unit 23 may be small, for example, and the value output by the toner density sensor 46 may vary as shown by a curve C1 of FIG. 7 during the first period. In this case, the value output by the toner density sensor 46 reaches the value within the predetermined range of the reference value Vr during the first period. The stir controller 61 then completes the stir operation at a timing ta at which the determining part 63 determines that the value output by the toner density sensor 46 reaches the value within predetermined range of the reference value Vr.

When the value output by the toner density sensor 46 does not reach the value within the predetermined range of the reference value Vr during the first period, the stir controller 61 switches the stir operation from the first operation to the second operation at timing T1. The developer that was not sufficiently loosened with the first operation may be loosened gradually with the second operation so the stir operation is switched from the first operation to the second operation. The stir controller 61 enables the developing unit 23 to continue the second stir operation during the second period from timing T1 to timing T2. The value output by the toner density sensor 46 may vary as shown by a curve C2 of FIG. 7 during the second period. The stir controller 61 then completes the stir operation at timing tb at which the determining part 63 determines that the value output by the toner density sensor 46 reaches the value within predetermined range of the reference value Vr.

When the value output by the toner density sensor 46 does not reach the value within the predetermined range of the reference value Vr during the second period, the stir controller 61 switches the stir operation from the second operation to the third operation at timing T2. The developer that was not sufficiently loosened with the second operation may be loosened gradually with the third operation so the stir operation is switched from the second operation to the third operation. The stir controller 61 enables the developing unit 23 to continue the third stir operation during the third period from the timing T2 to timing T3. The value output by the toner density sensor 46 may vary as shown by a curve C3 of FIG. 7 during the third period. The stir controller 61 then completes the stir operation at timing tc at which the determining part 63 determines that the value output by the toner density sensor 46 reaches the value within predetermined range of the reference value Vr.

When the value output by the toner density sensor 46 does not reach the value within the predetermined range of the reference value Vr during the third period, the stir controller 61 switches the stir operation from the third operation to the fourth operation at timing T3. The developer that was not sufficiently loosened with the third operation may be loosened gradually with the fourth operation so the stir operation is switched from the third operation to the fourth operation. The stir controller 61 enables the developing unit 23 to continue the fourth stir operation during the fourth period from the timing T3 to timing T4. The stir controller 61 then completes the stir operation when the value output by the toner density sensor 46 reaches the value within predetermined range of the reference value Vr.

In contrast, the value output by the toner density sensor 46 may vary as shown by a curve C4 of FIG. 7 during the fourth period. In this case, the value output by the toner density sensor 46 does not reach the value within the predetermined range of the reference value Vr, and the stir period elapses. The stir controller 61 then completes the stir operation at timing T4 which is the end of the stir period. Even when the stir period elapses, the value output by the toner density sensor 46 may not reach the value within the predetermined range of the reference value Vr. In such a case, the abnormality is notified by the determining part 63.

As described above, the stir controller 61 performs the multiple types of stir operations during the stir period set in advance to loosen the aggregated toner so that the stir controller 61 enables the bulk density of the developer to back to the condition almost equivalent to the condition in time of factory shipment. Before an elapse of the stir period, the stir controller 61 completes the stir operation at point of time the bulk density of the developer is back to the condition almost equivalent to the condition in time of the factory shipment. Thus, the image forming device 1 is enabled to be back to the state available for the user earlier than the ordinary way.

Even when the bulk density of the developer is not back to the condition almost equivalent to the condition in time of the factory shipment, the stir controller 61 completes the stir operation after the elapse of the stir period set in advance. This prevents the image forming device 1 from not being available for a long time. In this case, the determining part 63 notifies the abnormality and the processing of the print job by the job controller 56 is restricted. The prompt procedure can be taken by a maintenance operator, for instance. The generation of smoke or an occurrence of the density defect of the sheet material 9 on which the image is formed can be avoided.

Figure 8:
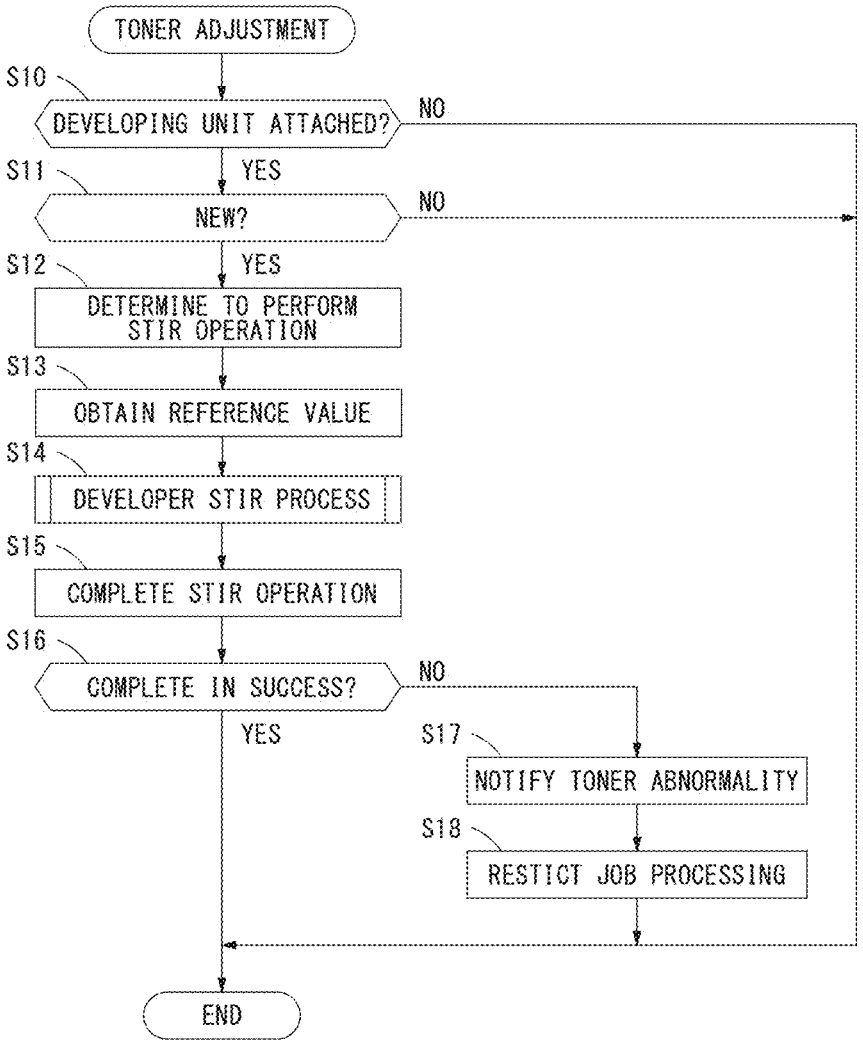
FIG. 8 illustrates a flow diagram explaining an exemplary procedure of the process performed by the controller.
Figure 9:
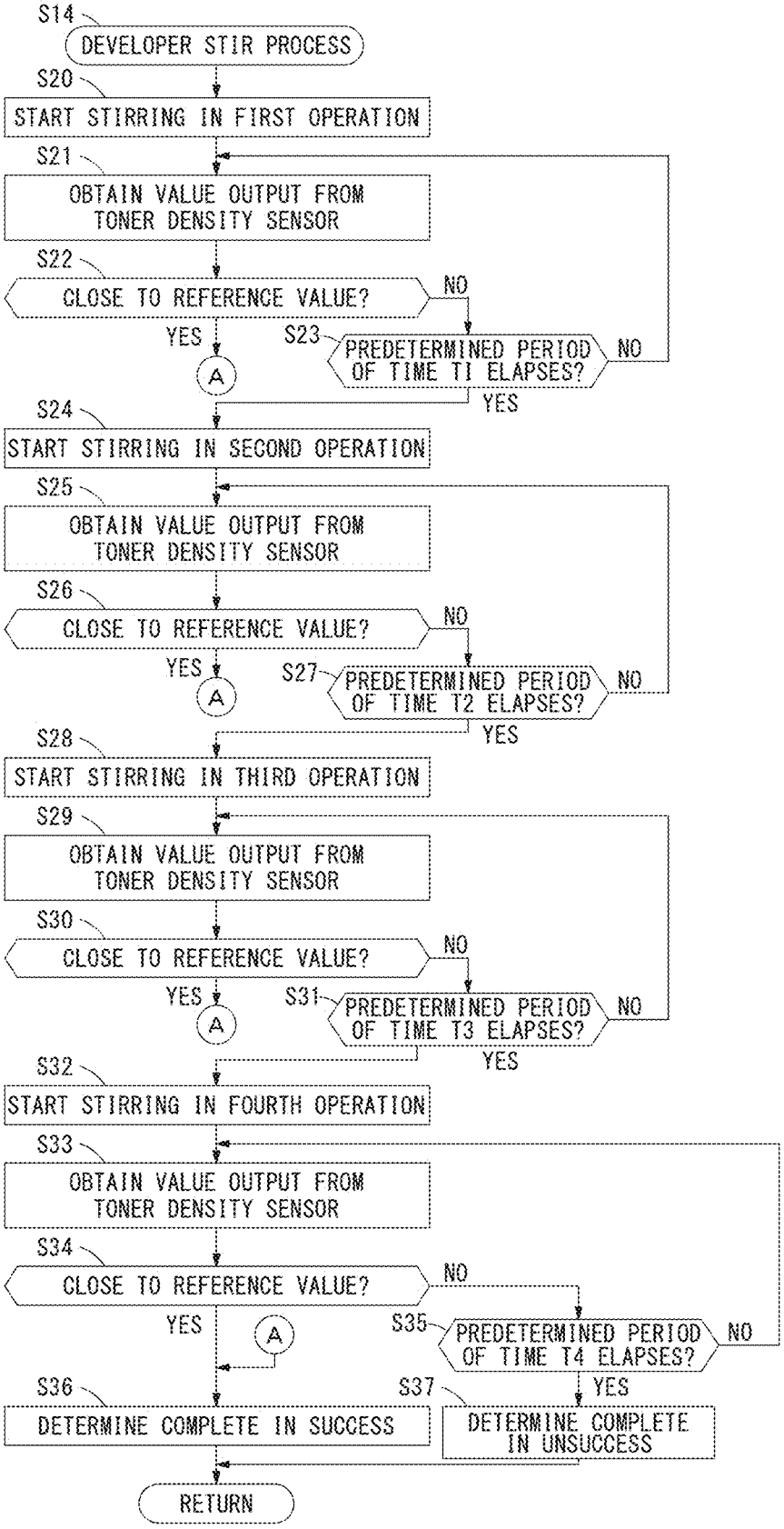
FIG. 9 illustrates a flow diagram explaining an exemplary procedure of a developer stir process in detail.

A detailed process sequence performed in the above-described controller 7 is explained next. FIGS. 8 and 9 illustrate examples of flow diagrams explaining exemplary procedures of the process performed by the controller 7. This process illustrated in FIGS. 8 and 9 is performed by the toner adjusting unit 55 of the controller 7. Upon start of the process, the controller 7 determines if the developing unit 23 is attached to the device body 1*a* (step S10). If the attachment of the developing unit 23 is not detected (when a result of step S10 is NO), the process by the controller 7 completes. The attachment of the developing unit 23 may be detected (when a result of step S10 is YES). In this case, the controller 7 determines if the attached developing unit 23 is new (step S11). An electronic part such as a fuse is equipped in the developing unit 23, for example. When the electricity is supplied to the developing unit 23 after the attachment of the developing unit 23, the electronic part such as the fuse is cut. The controller 7 determines if the developing unit 23 is new by detecting the state of the electronic part upon the attachment of the developing unit 23. The developing unit 23 attached to the device body 1*a* may not be new (when a result of step S11 is NO). In this case, the process by the controller 7 completes.

When the developing unit 23 attached to the device body 1*a* is new (when a result of step S11 is YES), the controller 7 determines to perform the stir operation of the developer as the initial operation of the developing unit 23 (step S12). The controller 7 obtains the reference value Vr set in advance at the factory shipment of the developing unit 23 (step S13). The controller 7, for example, obtains the reference value Vr stored in advance in the storage 47 of the developing unit 23 attached to the device body 1*a*. After obtaining the reference value Vr recorded in time of the measurement of the certain toner density D1 by the toner density sensor 46 equipped with the developing unit 23, the controller 7 starts a developer stir process (step S14).

FIG. 9 illustrates a flow diagram explaining an exemplary procedure of the developer stir process (step S14) in detail. After starting the developer stir process as the initial operation of the developing unit 23, the controller 7 starts the first operation to stir the developer at first (step S20). To be more specific, the controller 7 enables the stir screw 43 to rotate in the forward direction at low speed and activates the vibration members 48 to vibrate the developer to stir the developer. Upon starting the first operation, the controller 7 obtains the value output by the toner density sensor 46 equipped with the developing unit 23 (step S21), and determines if the value is close to the reference value Vr (step S22). To be more specific, the controller 7 determines if the toner density detected by the toner density sensor 46 is the value within the predetermined range of the reference value Vr. The toner density detected by the toner density sensor 46 may be the value within the predetermined range of the reference value Vr as a result of the determination (when a result of step S22 is YES). In this case, the process by the controller 7 proceeds to step S36.

Upon determining that the toner density detected by the toner density sensor 46 is not the value within the predetermined range of the reference value Vr as a result of the determination in step S22 (when a result of step S22 is NO), the controller 7 determines if the predetermined period of time (the first term from timing T0 to timing T1 illustrated in FIG. 7) has elapsed after the stir operation has started (step S23). The predetermined period of time may have not elapsed (when a result of step S23 is NO). In this case, the process by the controller 7 returns to step S21 to repeat the above-described process. The predetermined period of time may have elapsed (when a result of step S23 is YES). In this case, the process by the controller 7 proceeds to step S24.

In step S24, the controller 7 switches the stir operation from the first operation to the second operation and starts stirring the developer with the second operation (step S24). To be more specific, the controller 7 enables the stir screw 43 to rotate in the reverse direction at low speed and activates the vibration members 48 to vibrate the developer to stir the developer. The controller 7 obtains the value output by the toner density sensor 46 equipped with the developing unit 23 (step S25), and determines if the obtained value is close to the reference value Vr (step S26). The value output by the toner density sensor 46 may be within the predetermined range of the reference value Vr as a result of the determination (when a result of step S26 is YES). In this case, the process by the controller 7 proceeds to step S36.

Upon determining that the value output by the toner density sensor 46 is not within the predetermined range of the reference value Vr as a result of the determination in step S26 (when a result of step S26 is NO), the controller 7 determines if the predetermined period of time (the second term from timing T1 to timing T2 illustrated in FIG. 7) has elapsed after the stir operation has started (step S27). The predetermined period of time may have not elapsed (when a result of step S27 is NO). In this case, the process by the controller 7 returns to step S25 to repeat the above-described process. The predetermined period of time may have elapsed (when a result of step S27 is YES). In this case, the process by the controller 7 proceeds to step S28.

In step S28, the controller 7 switches the stir operation from the second operation to the third operation and starts stirring the developer with the third operation (step S28). To be more specific, the controller 7 enables the stir screw 43 to rotate in the forward direction at high speed and activates the vibration members 48 to vibrate the developer to stir the developer. The controller 7 obtains the value output by the toner density sensor 46 equipped with the developing unit 23 (step S29), and determines if the obtained value is close to the reference value Vr (step S30). The value output by the toner density sensor 46 may be within the predetermined range of the reference value Vr as a result of the determination (when a result of step S30 is YES). In this case, the process by the controller 7 proceeds to step S36.

Upon determining that the value output by the toner density sensor 46 is not within the predetermined range of the reference value Vr as a result of the determination in step S30 (when a result of step S30 is NO), the controller 7 determines if the predetermined period of time (the third term from timing T2 to timing T3 illustrated in FIG. 7) has elapsed after the stir operation has started (step S31). The predetermined period of time may have not elapsed (when a result of step S31 is NO). In this case, the process by the controller 7 returns to step S29 to repeat the above-described process. The predetermined period of time may have elapsed (when a result of step S31 is YES). In this case, the process by the controller 7 proceeds to step S32.

In step S32, the controller 7 switches the stir operation from the third operation to the fourth operation and starts stirring the developer with the fourth operation (step S32). To be more specific, the controller 7 enables the stir screw 43 to rotate in the reverse direction at high speed and activates the vibration members 48 to vibrate the developer to stir the developer. The controller 7 obtains the value output by the toner density sensor 46 equipped with the developing unit 23 (step S33), and determines if the obtained value is close to the reference value Vr (step S34). The value output by the toner density sensor 46 may be within the predetermined range of the reference value Vr as a result of the determination (when a result of step S34 is YES). In this case, the process by the controller 7 proceeds to step S36.

In step S36, the controller 7 determines that the bulk density of the developer is back to the condition almost equivalent to the condition in time of the factory shipment, and determines the stir operation of the developer successfully completes (step S36). More specifically, the controller 7 determines that the stir operation of the developer successfully completes at time the developer is sufficiently loosened during the stir period set in advance.

The controller 7 may determine that the value output by the toner density sensor 46 has not reached the value within the predetermined range of the reference value Vr as a result of the determination in step S34 (when a result of step S34 is NO). In this case, the controller 7 determines if the predetermined period of time (the fourth term from timing T3 to timing T4 illustrated in FIG. 7) has elapsed after the stir operation has started (step S35). The predetermined period of time may have not elapsed (when a result of step S35 is NO). In this case, the process by the controller 7 returns to step S33 to repeat the above-described process. The predetermined period of time may have elapsed (when a result of step S35 is YES). The process by the controller 7 then determines that the bulk density of the developer could not be back to the condition almost equivalent to the condition in time of the factory shipment, and determines the stir operation of the developer completes unsuccessfully (step S37). Thus, the developer stir process (step S14) completes.

Referring back to the flow diagram of FIG. 8, after the developer stir process (step S14), the controller 7 drives the stir screw 43 and the vibration members 48 to complete the stir operation (step S15). The controller 7 then determines if the developer stir process (step S14) is successfully complete (step S16). Upon determining that the developer stir process (step S14) is successfully complete (when a result of S16 is YES), the toner adjustment performed by the controller 7 completes.

The stir operation in the developer stir process (step S14) may be determined to be unsuccessfully complete (when a result of S16 is NO). In such a case, the controller 7 notifies the abnormality of toner (step S17). As a result, the controller 7 is enabled to notify the user or the maintenance operator that the toner density shows an abnormal value. The controller 7 also restricts the processing of the print job by the job controller 56 (step S18). As a result, the problem such as the generation of smoke and/or the density defect can be avoided.

As described above, the developing unit 23 filled with the developer containing the toner is detachable and removable to and from the device body 1*a* of the image forming device 1 of the first embodiment. As the initial operation of the developing unit 23 attached to the device body 1*a*, the image forming device 1 of the first embodiment enables the developing unit 23 to perform the stir operation of the developer filed in the developing unit 23. The image forming device 1 compares the toner density output from the developing unit 23 during the stir operation of the developer with the reference value Vr, and determines the stir condition of the developer. The image forming device 1 refers to the value set in advance as the reference value Vr at the factory shipment so that the image forming device 1 is enabled to precisely determine if the developer filled in the developing unit 23 has been loosened to the condition almost equivalent to the condition in time of the factory shipment during the stir operation of the developer. As a result, the image forming device 1 is enabled to complete the stir operation as the initial operation at timing the developer is sufficiently loosened. This can avoid the longer setup time at the customer site.

When the developer is not sufficiently loosened, the image forming device 1 is enabled to stop processing of the print job. This solves the problem such as the generation of smoke and/or the density defect.

Second Embodiment

The second embodiment of the present invention is explained next. In the above-described first embodiment, the reference value Vr of the toner density set in advance at the factory shipment is stored in the storage 47 installed in the developing unit 23. In the second embodiment, the reference value Vr of the toner density set in advance at the factory shipment is stored in a server. The structure of the image forming device 1 of the second embodiment is the same as that explained in the first embodiment.

Figure 10:
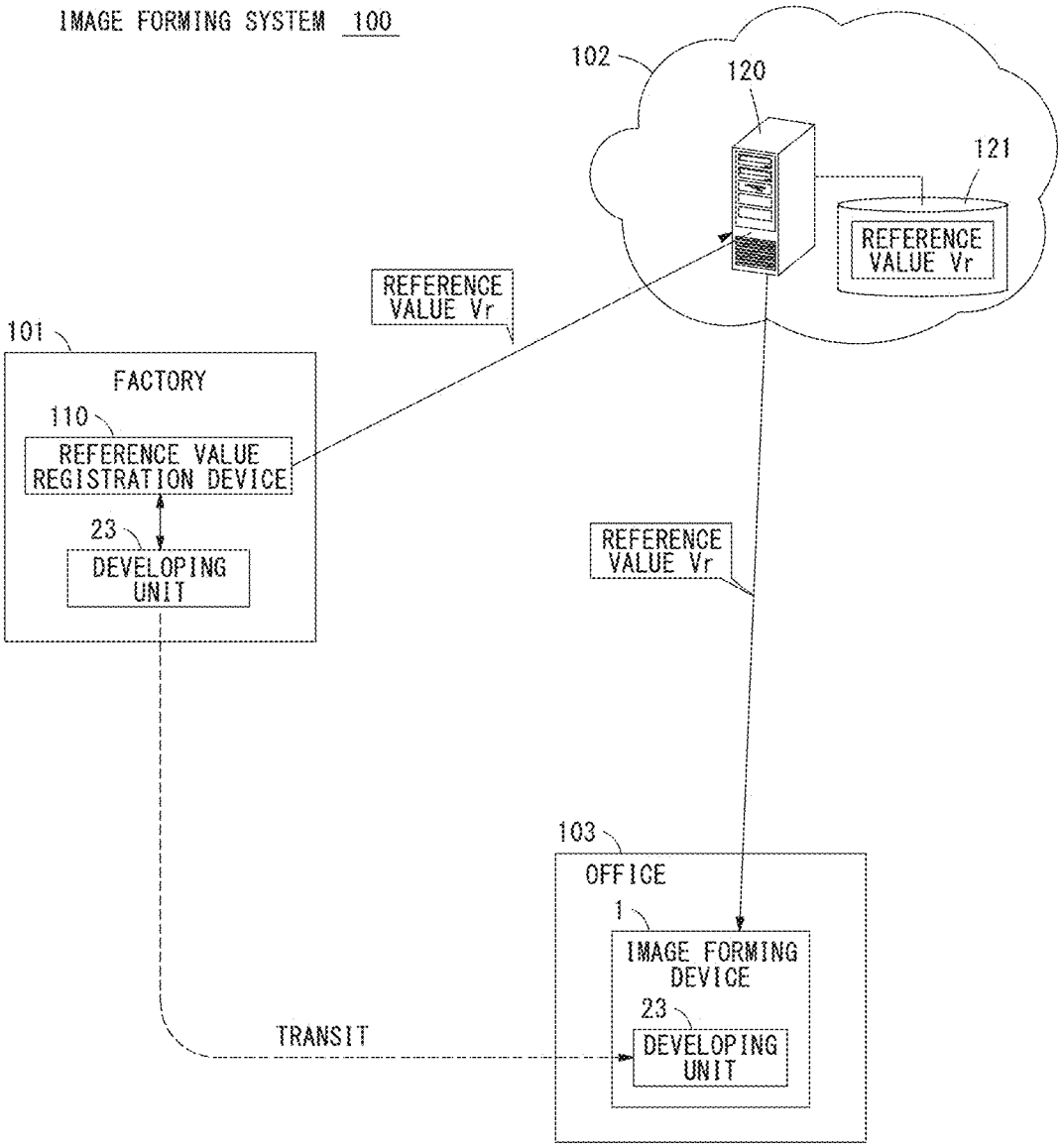
FIG. 10 illustrates an exemplary conceptual configuration of an information forming system including the image forming device.

FIG. 10 illustrates an exemplary conceptual configuration of an information forming system 100 including the image forming device 1. The image forming system 100 includes a reference value registration device 110 which is installed in a factory 101 that manufactures the developing unit 23, a server 120 installed on a cloud 102 such as an internet and the image forming device 1 installed in a place such as an office 103 at a client site.

In the factory 101, the reference value registration device 110 and the developing unit 23 are connected to each other prior to the shipment of the developing unit 23, and the reference value registration device 110 is enabled to obtain the value output from the toner density sensor 46 equipped with the developing unit 23. While it is available for the reference value registration device 110 to obtain the value output from the toner density sensor 46, the developer filled in the body 40 of the developing unit 23 may be stirred sufficiently. In such a case, the reference value registration device 110 enables the toner density sensor 46 to measure the toner density and obtain the value output from the toner density sensor 46. The reference value registration device 110 then sends the obtained value to the server 120 as the reference value Vr. The reference value registration device 110 sends identification information such as a serial number for identifying the developing unit 23 to the server 120 together with the reference value Vr.

The server 120 includes a storage device 121 formed from a hard disk drive (HDD) or a solid-state drive (SSD), for example. Upon receiving the reference value Vr from the reference value registration device 110 in the factory 101 and the identification information of the developing unit 23, the server 120 associates the reference value Vr and the identification with each other and stores in the storage device 121. More specifically, the image forming system 1 of the second embodiment stores the reference value Vr set in advance at the factory shipment of the developing unit 23 in the server 120.

The developing unit 23, the reference value Vr of which is stored in the server 120, is shipped from the factory 101. After a variety of transit process and storage process, the developing unit 23 is carried to the client's office 103 and attached to the device body 1*a* of the image forming device 1. For bringing the developing unit 23 attached to the device body 1*a* into operation for the first time, the image forming device 1 performs the initial operation of the developing unit 23. More specifically, the image forming device 1 performs the stir operation to stir the developer filled in the developing unit 23. In performing the stir operation, the reference value obtaining part 62 of the image forming device 1 is brought into operation to obtain the reference value Vr set in advance at the factory shipment of the developing unit 23.

The reference value obtaining part 62 of the second embodiment accesses the server 120 on the cloud 102 via the communication interface 54, and obtains the reference value Vr corresponding to the developing unit 23 from the server 120. The reference value obtaining part 62, for example, displays a screen to ask for the input of the identification information of the developing unit 23 on the display unit 53*a* of the operational panel 53, and receives the input operation of the identification information by the user or the maintenance operator. The reference value obtaining part 62 sends the identification information input by the user or the maintenance operator to the server 120, and obtains the reference value Vr corresponding to the developing unit 23 attached to the device body 1*a* from the server 120. When the identification information of the developing unit 23 is stored in the storage 47 of the developing unit 23, the reference value obtaining part 62 may read the identification information in the storage 47 and send the read identification information to the server 120.

After the reference value Vr is obtained from the server 120 by the reference value obtaining part 62, the image forming device 1 can perform the similar operation as the operation explained in the first embodiment.

As described above, the image forming device 1 of the first embodiment stores the reference value Vr of the toner density set in advance in time of the factory shipment of the developing unit 23 in the server 120, and obtains the reference value Vr from the server 120. With this structure, the developing unit 23 does not have to be equipped with the storage 47 to store the reference value Vr. The inexpensive developing unit 23 can be provided.

Everything else except for the points described above in the second embodiment is the same as that explained in the first embodiment. The working-effect explained in the first embodiment can be also obtained in the second embodiment.

Although embodiments of the present invention have been described and illustrated in detail, the disclosed embodiments are made for purposes of illustration and example only and not limitation. The scope of the present invention should be interpreted by terms of the amended claims.

Modifications

While the embodiment of the present invention has been described above, the present invention is not limited to the embodiment. Various modifications may be applied to the present invention.

In the above-described embodiments, for example, the developer which is sufficiently loosened is measured by the toner density sensor 46 in time of the factory shipment of the developing unit 23 and the reference value Vr of the toner density is set. The toner density does not actually have to be measured by the toner density sensor 46 in time of the factory shipment. If the output characteristic corresponding to the individual difference of the toner density sensor 46 is measured at the factory shipment of the developing unit 23, for example, the reference value Vr can be set by operation based on the output characteristic.

The image forming device 1 of the above-described embodiments is constructed by a color device capable of producing a printed color outputs. However, this is given not for limitation. The image forming device 1 does not always have to be the color device. The image forming device 1 may be a black and white only device.

In the above-described embodiments, the program 52 is installed in advance in the controller 7 of the image forming device 1. The program 52 may be installed in the controller 7 via the communication interface 54, for example. In this case, the program 52 may be provided over internet in a manner that enables a user to download, or may be provided in a manner that is recorded on a computer readable recording medium such as a CD-ROM or a USB memory.

What is claimed is:

1. An image forming device to and from which a developing unit in which a developer containing toner is filled is detachable and removable, comprising a hardware processor that:

enables the developing unit to perform a stir operation of the developer filled in the developing unit as an initial operation of the developing unit;

obtains a reference value of a toner density set in advance in time of a factory shipment of the developing unit at time the stir operation is performed; and compares a toner density received from the developing unit during the stir operation with the reference value to determine a stir condition of the developer.

2. The image forming device according to claim 1, wherein the hardware processor completes the stir operation when the toner density received from the developing unit during the stir operation reaches a value within a predetermined range of the reference value.

3. The image forming device according to claim 1, wherein the developing unit comprises a toner density sensor that detects the toner density of the filled developer, and the hardware processor compares the toner density received from the toner density sensor during the stir operation with the reference value.

4. The image forming device according to claim 3, wherein the hardware processor obtains the toner density detected by the toner density sensor in time of the factory shipment of the developing unit as the reference value.

5. The image forming device according to claim 4, wherein the developing unit further comprises a storage in which the toner density detected by the toner density sensor is stored as the reference value, and the hardware processor obtains the reference value stored in the storage.

6. The image forming device according to claim 1, wherein the developing unit comprises a stir part to stir the filled developer, and the hardware processor drives the stir part to enable the developing unit to perform the stir operation.

7. The image forming device according to claim 6, wherein the stir part comprises a stir screw arranged in a filling space of the developer, and the hardware processor rotates the stir screw.

8. The image forming device according to claim 7, wherein the hardware processor changes the speed of the stir screw from a predetermined speed to a different speed when the toner density received from the developing unit does not reach the value within the predetermined range of the reference value upon rotating the stir screw for a predetermined period of time at the predetermined speed.

9. The image forming device according to claim 7, wherein the hardware processor changes a direction of the stir screw from a predetermined direction to another direction when the toner density received from the developing unit does not reach the value within the predetermined range of the reference value upon rotating the stir screw for the predetermined period of time in the predetermined direction.

10. The image forming device according to claim 6, wherein the stir part, comprises a vibration member attached to a body of the developing unit, and the hardware processor drives the vibration member to provide the developer filled in the developing unit with a vibration.

11. The image forming device according to claim 1, wherein the hardware processor notifies of an abnormality when the toner density received from the developing unit does not reach the value within the predetermined range of the reference value at time a stir period set in advance elapses from the start of the stir operation.

12. The image forming device according to claim 1, wherein the hardware processor restricts processing of a job when the toner density received from the developing unit does not reach the value within the predetermined range of the reference value at time the stir period set in advance elapses from the start of the stir operation.

13. A developer stirring method, comprising:

setting in advance a reference value of a toner density in time of a factory shipment of a developing unit in which a developer containing toner is filled;

enabling the developing unit to perform a stir operation of the developer filled in the developing unit as an initial operation of the developing unit when the developing unit is attached to an image forming device and the developing unit becomes operative for the first time in the image forming device;

obtaining the reference value at time the stir operation is performed; and comparing a toner density received from the developing unit during the stir operation with the reference value to determine a stir condition of the developer.

14. The developer stirring method according to claim 13, wherein the stir operation is completed when the toner density received from the developing unit during the stir operation reaches a value within a predetermined range of the reference value.

15. The developer stirring method according to claim 13, wherein the reference value is stored in a predetermined server so that the reference value can be set, and the reference value is obtained from the server.

16. A non-transitory recording medium storing a computer readable program to be executed by a hardware processor in an image forming device to and from which a developing unit in which a developer containing toner is filled is detachable and removable, wherein the computer readable program causes the hardware processor executing the computer readable program to:

enable the developing unit to perform a stir operation of the developer filled in the developing unit as an initial operation of the developing unit;

obtain a reference value of a toner density set in advance in time of a factory shipment of the developing unit at time the stir operation is performed; and compare a toner density received from the developing unit during the stir operation with the reference value to determine a stir condition of the developer.

17. The non-transitory recording medium according to claim 16, wherein the stir operation is completed when the toner density received from the developing unit during the stir operation reaches a value within a predetermined range of the reference value.

18. The non-transitory recording medium according to claim 16, wherein the developing unit comprises a toner density sensor that detects the toner density of the filled developer, and the toner density received from the toner density sensor during the stir operation is compared with the reference value.

19. The non-transitory recording medium according to claim 18, wherein the toner density detected by the toner density sensor in time of the factory shipment of the developing unit is obtained as the reference value.

20. The non-transitory recording medium according to claim 19, wherein the developing unit further comprises a storage in which the toner density detected by the toner density sensor is stored as the reference value, and the reference value stored in the storage is obtained.

21. The non-transitory recording medium according to claim 16, wherein the developing unit comprises a stir part to stir the filled developer, and the stir part is driven to enable the developing unit to perform the stir operation.

22. The non-transitory recording medium according to claim 21, wherein the stir part comprises a stir screw arranged in a filling space of the developer, and the stir screw rotates.

23. The non-transitory recording medium according to claim 22, wherein the speed of the stir screw is changed from a predetermined speed to a different speed when the toner density received from the developing unit does not reach the value within the predetermined range of the reference value at time the stir screw rotates for a predetermined period of time at the predetermined speed.

24. The non-transitory recording medium according to claim 22, wherein a direction of the stir screw is changed from a predetermined direction to another direction when the toner density received from the developing unit does not reach the value within the predetermined range of the reference value at time the stir screw rotates for the predetermined period of time in the predetermined direction.

25. The non-transitory recording medium according to claim 21, wherein the stir part comprises a vibration member attached to a body of the developing unit, and the vibration member is driven to provide the developer filled in the developing unit with a vibration.

26. The non-transitory recording medium according to claim 16, wherein an abnormality is notified when the toner density received from the developing unit does not reach the value within the predetermined range of the reference value at time a stir period set in advance elapses from the start of the stir operation.

27. The non-transitory recording medium according to claim 16, wherein processing of a job is restricted when the toner density received from the developing unit does not reach the value within the predetermined range of the reference value at time the stir period set in advance elapses from the start of the stir operation.

* * * * *